US007309037B2

(12) United States Patent
Schmitz et al.

(10) Patent No.: US 7,309,037 B2
(45) Date of Patent: Dec. 18, 2007

(54) STATIONARY PEG FOR A COAL PULVERIZER

(75) Inventors: William Schmitz, Clymer, NY (US); Craig A. Penterson, Sutton, MA (US); Daniel P. Smith, Spencer, MA (US)

(73) Assignee: Riley Power, Inc., Worcester, MA (US)

( * ) Notice: Subject to any disclaimer, the term of this patent is extended or adjusted under 35 U.S.C. 154(b) by 0 days.

(21) Appl. No.: 11/011,884

(22) Filed: Dec. 14, 2004

(65) Prior Publication Data

US 2006/0124791 A1 Jun. 15, 2006

(51) Int. Cl.
*B02C 13/282* (2006.01)

(52) U.S. Cl. ..... 241/188.2; 241/197; 241/300

(58) Field of Classification Search ..... 241/188.1, 241/188.2, 197, 300
See application file for complete search history.

(56) References Cited

U.S. PATENT DOCUMENTS

| | | | | |
|---|---|---|---|---|
| 2,625,332 | A | 1/1953 | Rogers et al. | |
| 2,628,038 | A * | 2/1953 | Rogers et al. | 241/300 |
| 5,348,272 | A | 9/1994 | Lukstas et al. | |
| 6,443,376 | B1 | 9/2002 | Huang et al. | |

* cited by examiner

*Primary Examiner*—Faye Francis
(74) *Attorney, Agent, or Firm*—Edwards Angell Palmer & Dodge LLP

(57) ABSTRACT

The present invention is directed to, among other things, a stationary peg for securing within a grinding chamber of a coal pulverizer, wherein the stationary peg includes a base portion having a front surface with a groove defined therein and an elongate portion extending from the front surface of the base portion. A layer of a protective material is disposed on the upper surface of the elongate portion and at least a portion of the layer extends into the groove defined in the front surface of the base portion.

20 Claims, 7 Drawing Sheets

STATIONARY PEG FOR A COAL PULVERIZER

BACKGROUND OF THE INVENTION

1. Field of the Invention

The present invention relates to equipment for use in a material size reduction process, and more particularly, it concerns an improved stationary peg for use in a grinding chamber of a rotary coal pulverizer.

2. Background of the Related Art

In operations that use coal for fuel, finely-ground coal particles or "fines" are required for efficient operation, yielding higher combustion efficiency than stoker firing, as well as rapid response to load changes. Using coal fines for combustion also produces less nitrous oxide ($NO_X$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable range prior to being used for combustion.

Many pulverizers employ systems and methods including one or more crushing and grinding stages for breaking up the raw coal. For example, in a rotary pulverizer, the coal particles are reduced to dust fine enough to become airborne in an air stream swept through the pulverizer by a gradual process that includes crushing the coal by repeated crushing actions of swing hammers and grinding the coal by attrition caused by rotating elements. The dust particles are entrained in the air stream and carried out for combustion.

It should be readily apparent that the process of reducing solid coal to acceptably sized fines requires equipment and components of high strength and durability. Therefore, there exists a continuing need for components that can reduce solid coal to acceptably sized fines and yield greater overall efficiency by withstanding extremely harsh conditions and causing less operation downtime due to maintenance and repairs.

SUMMARY OF THE DISCLOSURE

The present invention improves upon and solves the problems associated with the prior art by providing, among other things, a stationary peg for attaching to an interior wall of a grinding chamber. The stationary peg of the present invention includes a generally cylindrical base portion having a front surface with a groove defined therein, and an elongate portion extending from the front surface of the base portion. The elongate portion has an upper surface that includes a layer of a protective material disposed thereon. The groove in the front surface of the base portion is positioned in the same plane as the layer of protective material disposed on the upper surface, and preferably, at least a portion of the layer of protective material is disposed in the groove.

The protective material may be any material which resists damage due to wear and tear in the material reduction process greater than the material employed to form the elongate and base portions. In the preferred embodiment, Ni-Hard in a ductile forging process is used to form the elongate and base portions. Tungsten carbide, which is 100 BHN (Brinell hardness number) harder than Ni-Hard, is preferred for use as the protective material.

In the preferred embodiment of the present invention, the elongate portion has a generally triangular cross sectional profile and the base portion includes a rim for facilitating attachment of the peg to the interior wall of a grinding chamber.

In another embodiment, the present invention is directed to a stationary peg for attaching to an interior wall of a grinding chamber that includes a base portion and an elongate portion extending from the base portion which has an upper surface with a layer of a protective material disposed thereon. The elongate portion has a generally triangular cross-sectional profile and the protective material in the layer is of a greater hardness than the material used to form the elongate portion.

The aforementioned stationary peg can also include a groove defined in the base portion and positioned in the same plane as the layer of protective material, and at least a portion of the layer of protective material can be disposed in the groove. This stationary peg can be made from a steel forging process and the protective material can be tungsten carbide.

The present invention is also directed to a coal pulverizer having a grinding chamber and a center shaft defining an axis of rotation and configured for rotational motion within the grinding chamber. The coal pulverizer of the present invention can include any of the stationary pegs for attaching to an interior wall of the grinding chamber as described herein.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the present invention pertains will more readily understand how to make and use the present invention, an embodiment thereof will be described in detail with reference to the drawings, wherein.

DETAILED DESCRIPTION OF THE PREFERRED EMBODIMENTS

Reference is now made to the figures and accompanying detailed description which have been provided to illustrate exemplary embodiments of the present invention, but are not intended to limit the scope of embodiments of the present invention. Although a particular type of rotary coal pulverizer is shown in the figures and discussed herein, it should be readily apparent that a device or system constructed in accordance with the present invention can be employed in a variety of other coal pulverizers, or other applications that do not involve coal as the raw material. In other words, the specific material and size reduction process is not vital to gaining the benefits associated with using a system constructed in accordance with the present invention.

Figure 1:
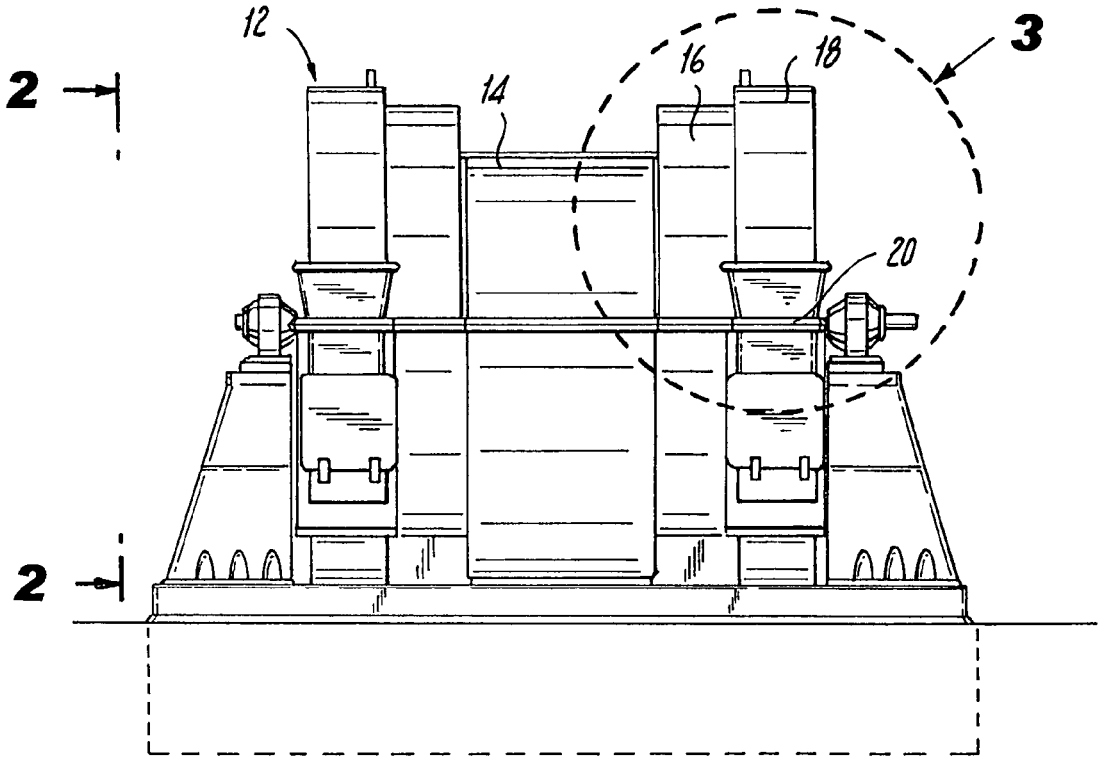
FIG. 1 is front view of an exemplary rotary coal pulverizer (duplex model) which can employ a classifier assembly constructed in accordance with the present invention therein mounted on the center shaft at two locations.
Figure 2:
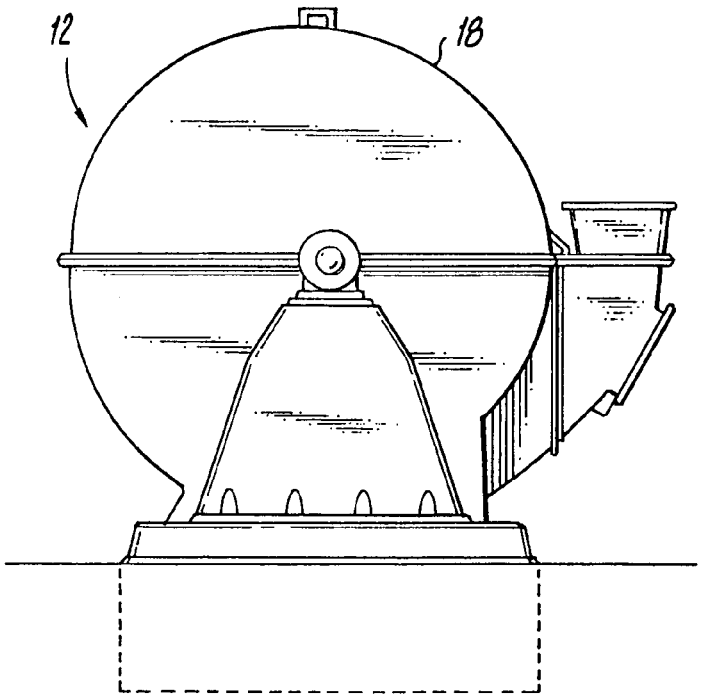
FIG. 2 is a side view of the rotary coal pulverizer of FIG. 1, illustrating the output from the fan section of the pulverizer.

FIGS. 1 and 2 illustrate the general location of a presently preferred embodiment of a stationary peg (hereinafter also referred to as a "peg") constructed in accordance with the present invention and employed in an exemplary rotary coal pulverizer 12, from the exterior of pulverizer 12. Pulverizer 12 is known as a horizontal type high speed coal mill and is closely based on a duplex model ATRITA® Pulverizer sold commercially by Babcock Power Inc. However, this should not be interpreted as limiting the present invention in any way, as many types of pulverizing devices employ similar elements and are suitable for use with the present invention.

The duplex model is essentially two single models side by side. It should be readily apparent that a peg constructed in accordance with the present invention may also be disposed in a single model. For purposes of ease and convenience in describing the features of the present invention, only a single side of the duplex model is discussed herein.

Figure 3:
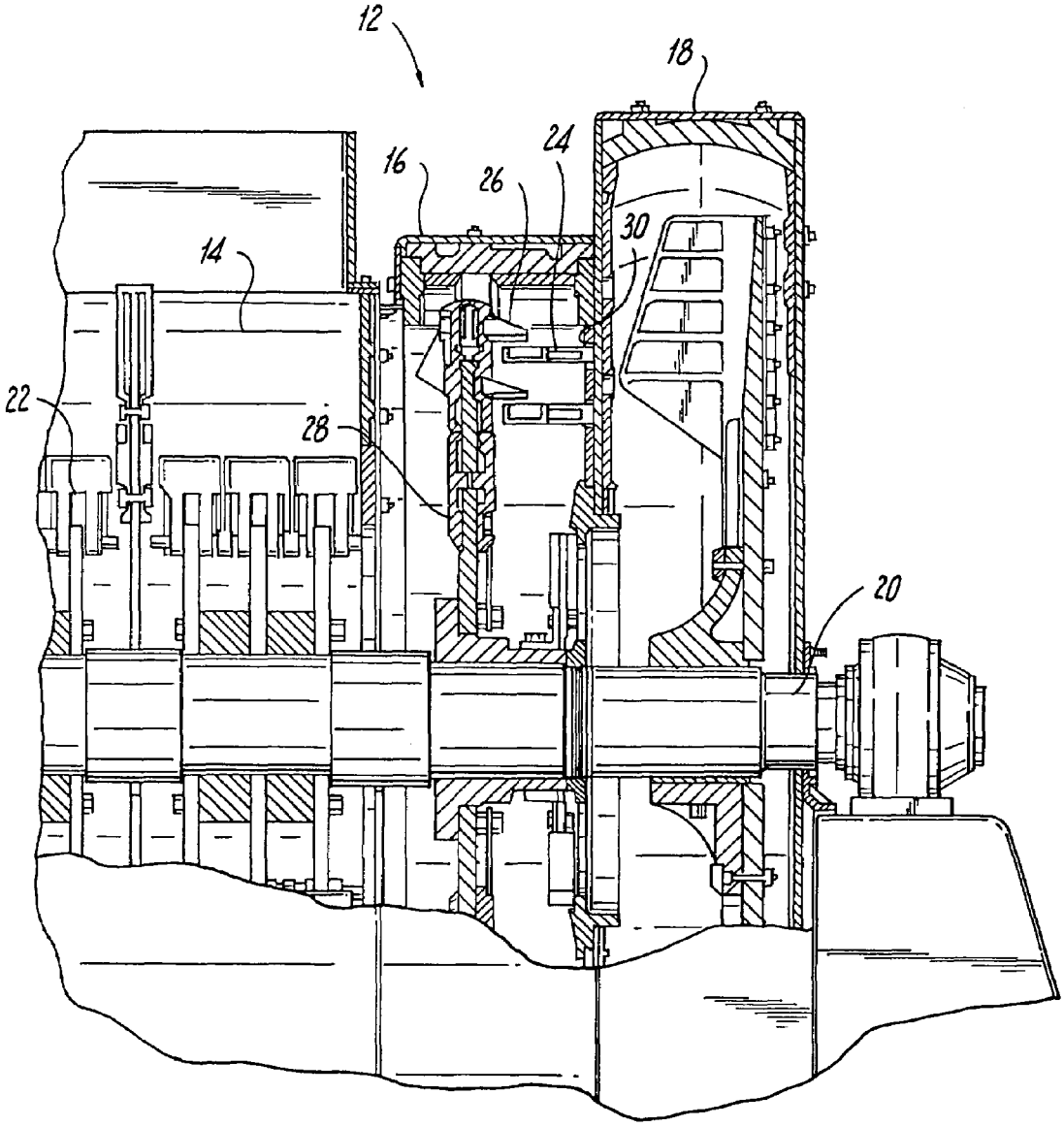
Fig. 3 (Prior Art)
FIG. 3 is an enlarged localized partial cross-sectional view of a portion of the exemplary rotary coal pulverizer of FIG. 1, illustrating a prior art stationary peg positioned on an interior wall in the grinding section.

As can be seen in FIG. 3, pulverizer 12 consists essentially of a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

Raw coal and primary air enter the crusher-dryer section 14. Swing hammers 22 mounted on and driven by center shaft 20, along with impact liners (not shown), operate to crush the coal against a grid (not shown). High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

Figure 4:
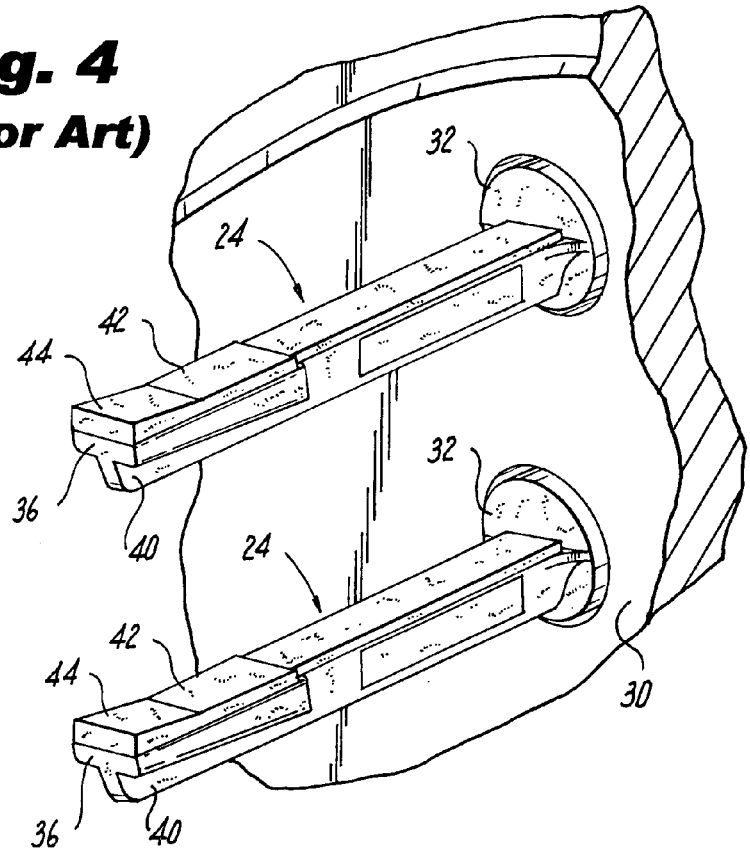
Fig. 4 (Prior Art)
FIG. 4 is a perspective partial view illustrating the arrangement of prior art stationary pegs on an interior wall in the grinding section.

When coal passes through the grid of the crusher-dryer section 14, it enters the axially outer adjacent grinding section 16. The major grinding components in grinding section 16 include stationary pegs 24 and grinding clips 26 disposed on a rotating wheel assembly 28 mounted on center shaft 20. As shown in FIG. 4, pegs 24 are arranged on interior grinding section wall 30 in spaced apart relationships with respect to each other. Furthermore, pegs 24 are perpendicular with respect to wall 30, and opposed to clips 26, but are spaced so that clips 26 and pegs 24 do not contact each other during rotation of wheel assembly 28.

Wheel 28 is driven by center shaft 20, preferably at a relatively high rate of speed. The turbulent flow and impact momentum on particles, caused by the movement of clips 26 and pegs 24, create a particle to particle attrition which further reduces the size of the coal particles received from crusher-dryer section 14.

Figure 5:
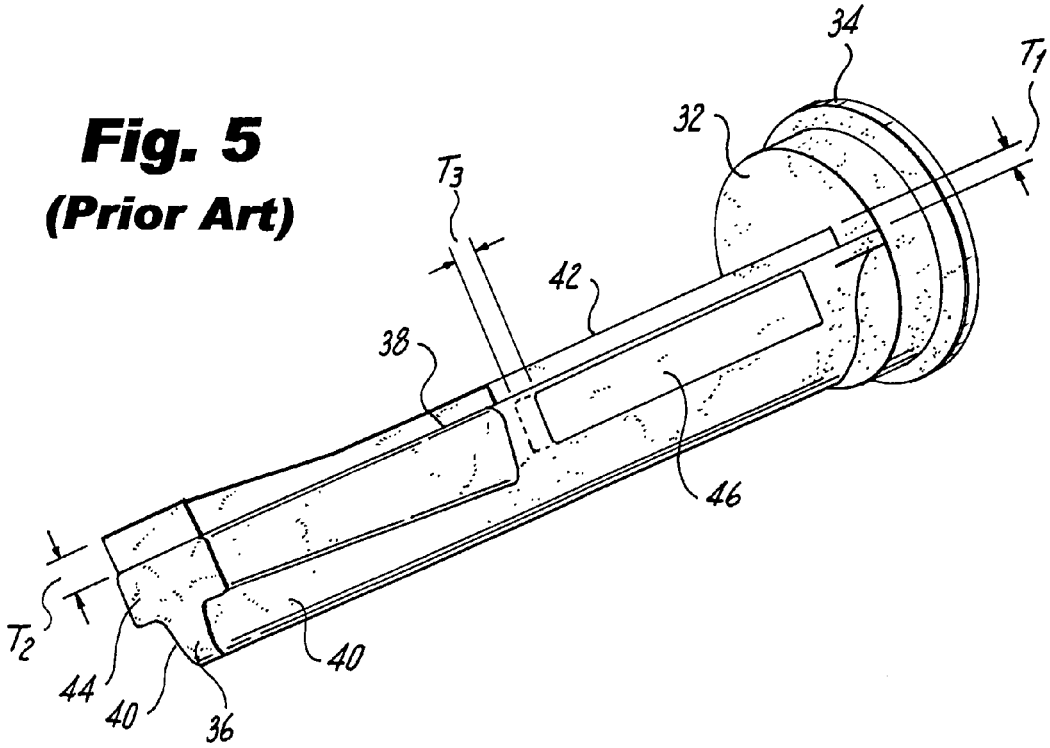
Fig. 5 (Prior Art)
FIG. 5 is a perspective view of a prior art stationary peg, illustrating, inter alia, the thickness of the protective layer adjacent the tip of the elongate portion and adjacent the base portion of the prior art stationary peg.
Figure 6:
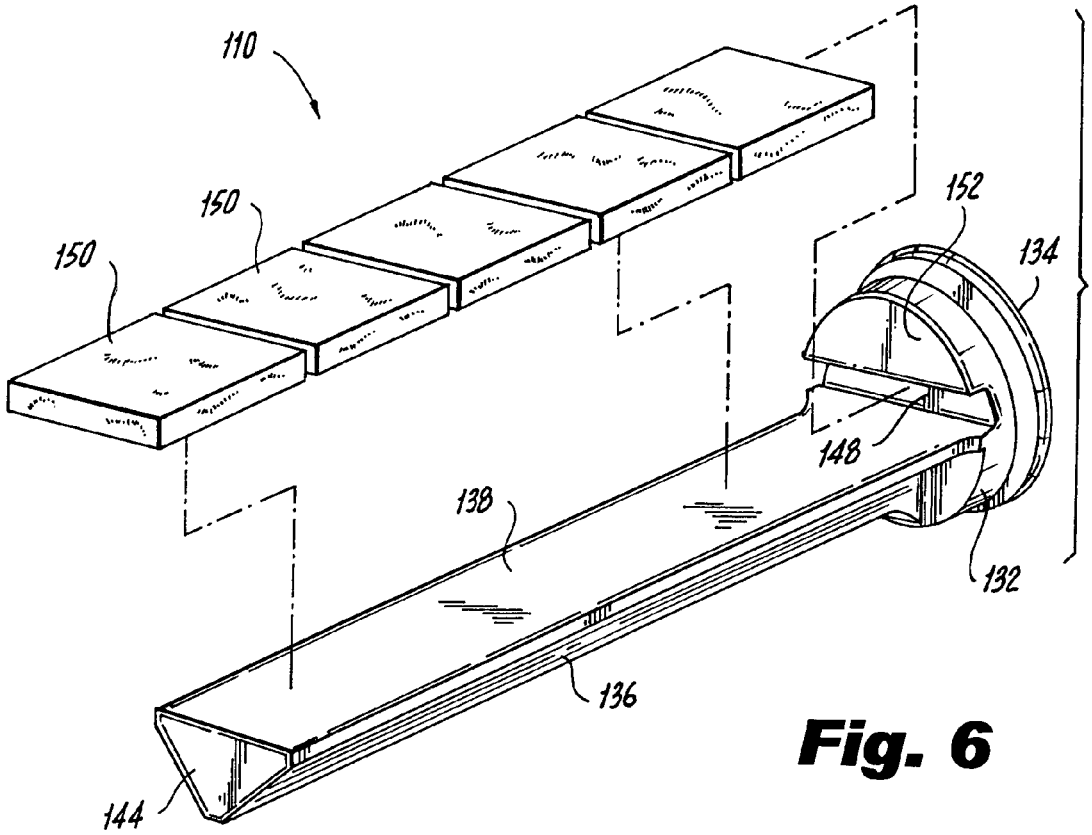
FIG. 6 is a perspective exploded view of a stationary peg constructed in accordance with the present invention, illustrating the protective layer of tiles fabricated of a second material with tiles removed from the upper surface of the elongate portion of the stationary peg of the present invention.
Figure 7:
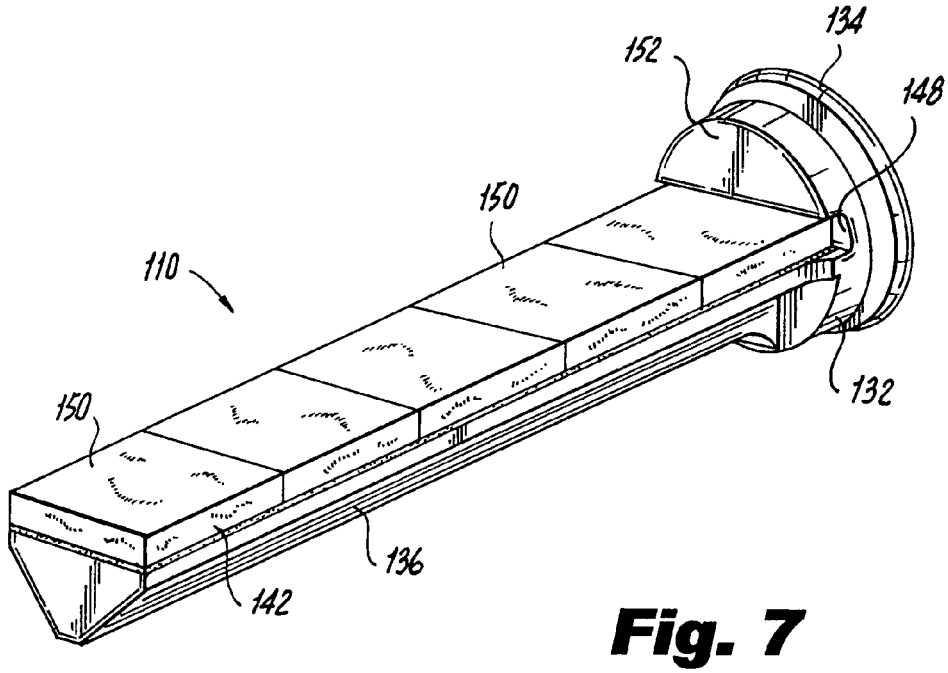
FIG. 7 is a perspective view of the stationary peg shown in FIG. 6 constructed in accordance with the present invention, illustrating the protective layer of tiles fabricated of the second material positioned on the upper surface of the elongate portion of the present invention.
Figure 8:
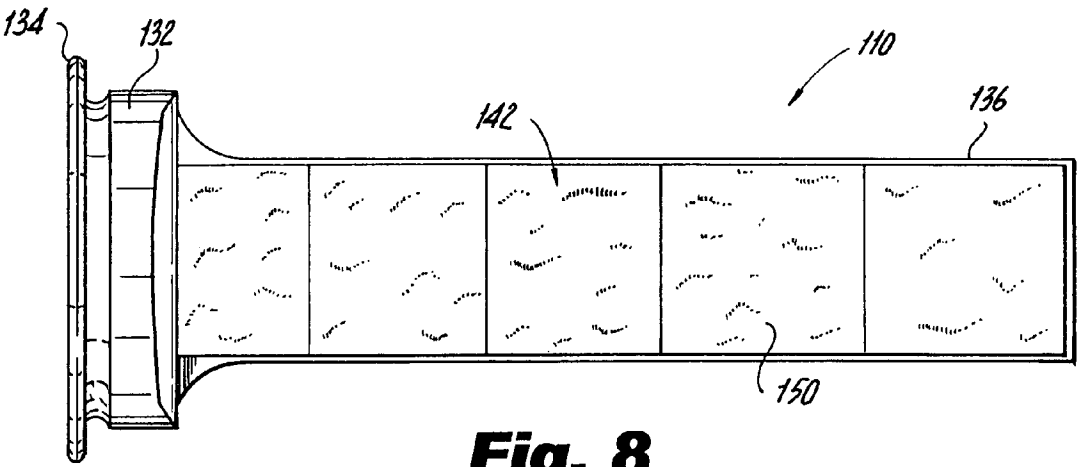
FIG. 8 is a top view of the stationary peg of FIG. 7.
Figure 9:
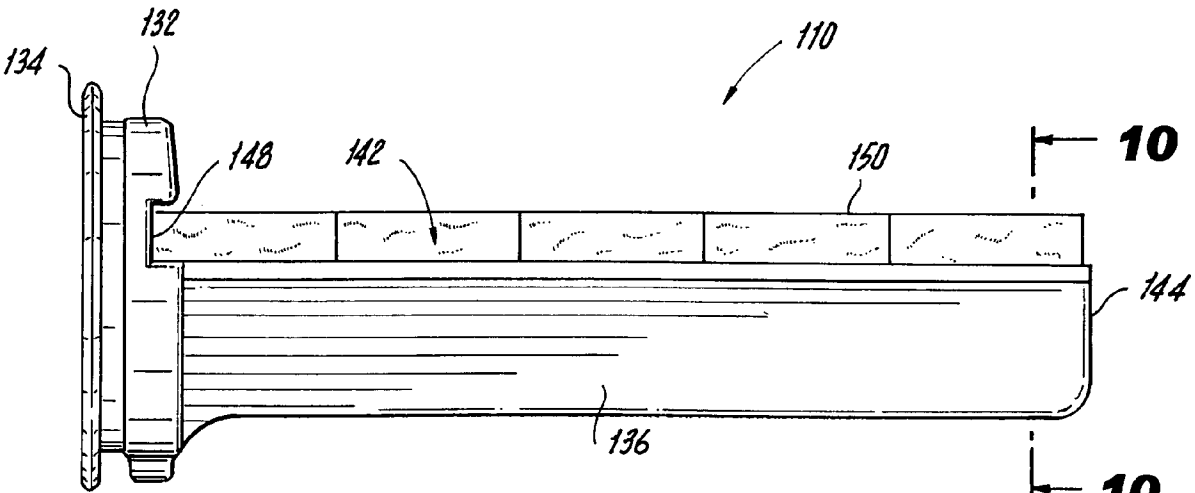
FIG. 9 is a side view of the stationary peg of FIG. 7, illustrating, inter alia, the groove in the front surface of the base portion positioned in the same plane as the protective layer of tiles fabricated of a second material and with a portion of a protective tiles disposed therein.
Figure 10:
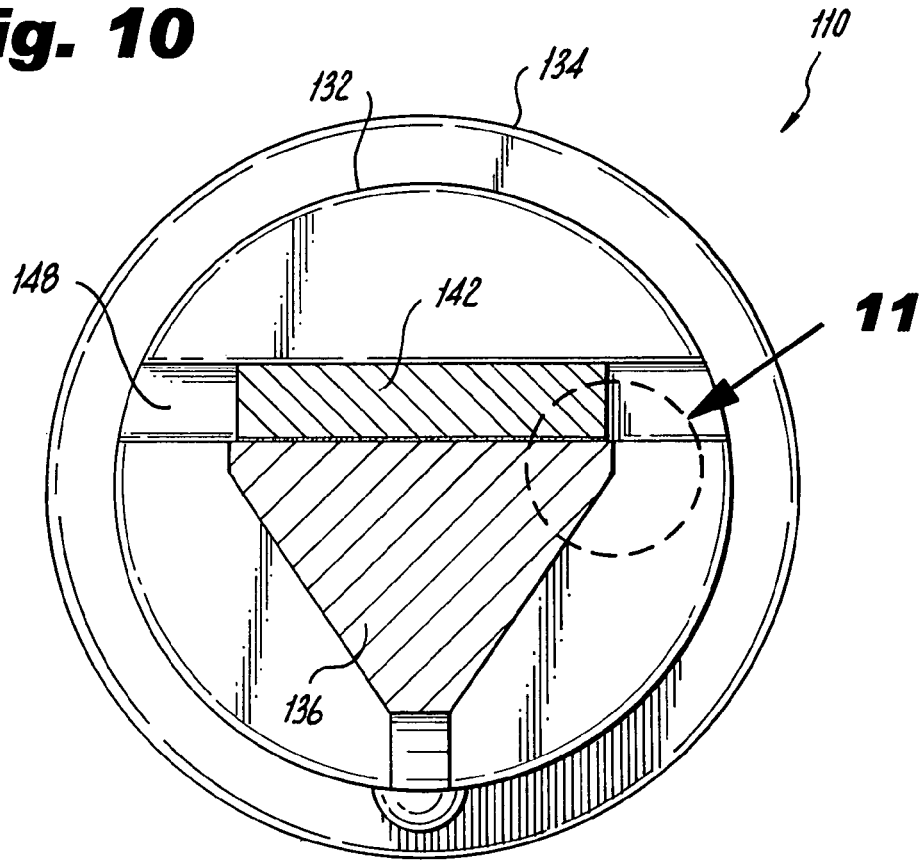
FIG. 10 is a front, partial cross sectional view of the stationary peg of FIG. 7, illustrating, inter alia, the generally triangular shape of the elongate portion cross section and front surface of the base portion.
Figure 11:
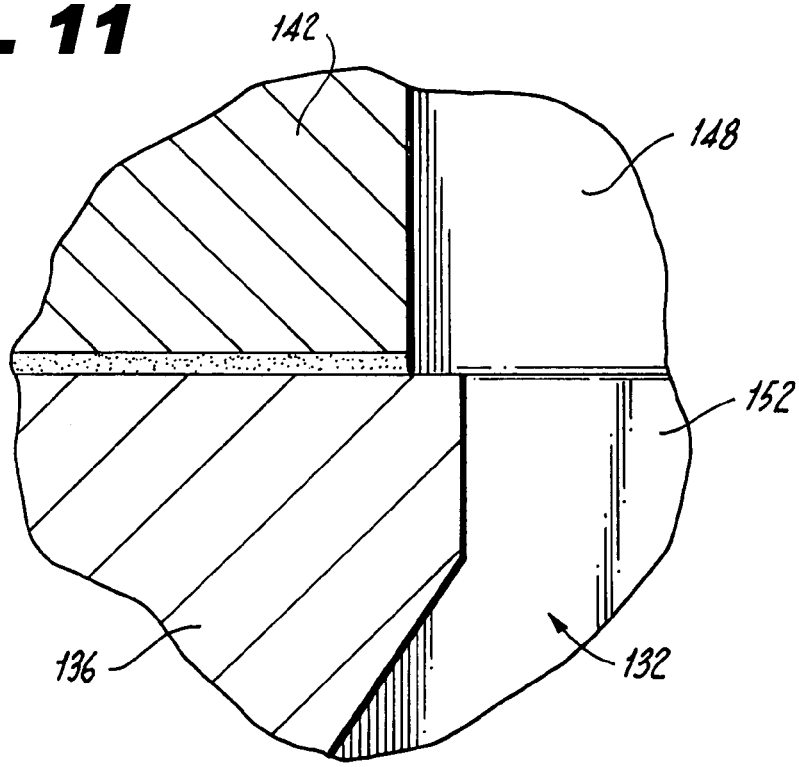
FIG. 11 is a close up partial view of the front surface of the stationary peg of FIG. 11, illustrating, inter alia, the positional relationship of the groove in the front surface of the base portion, the layer of second material and elongate portion of the present invention.
Figure 12:
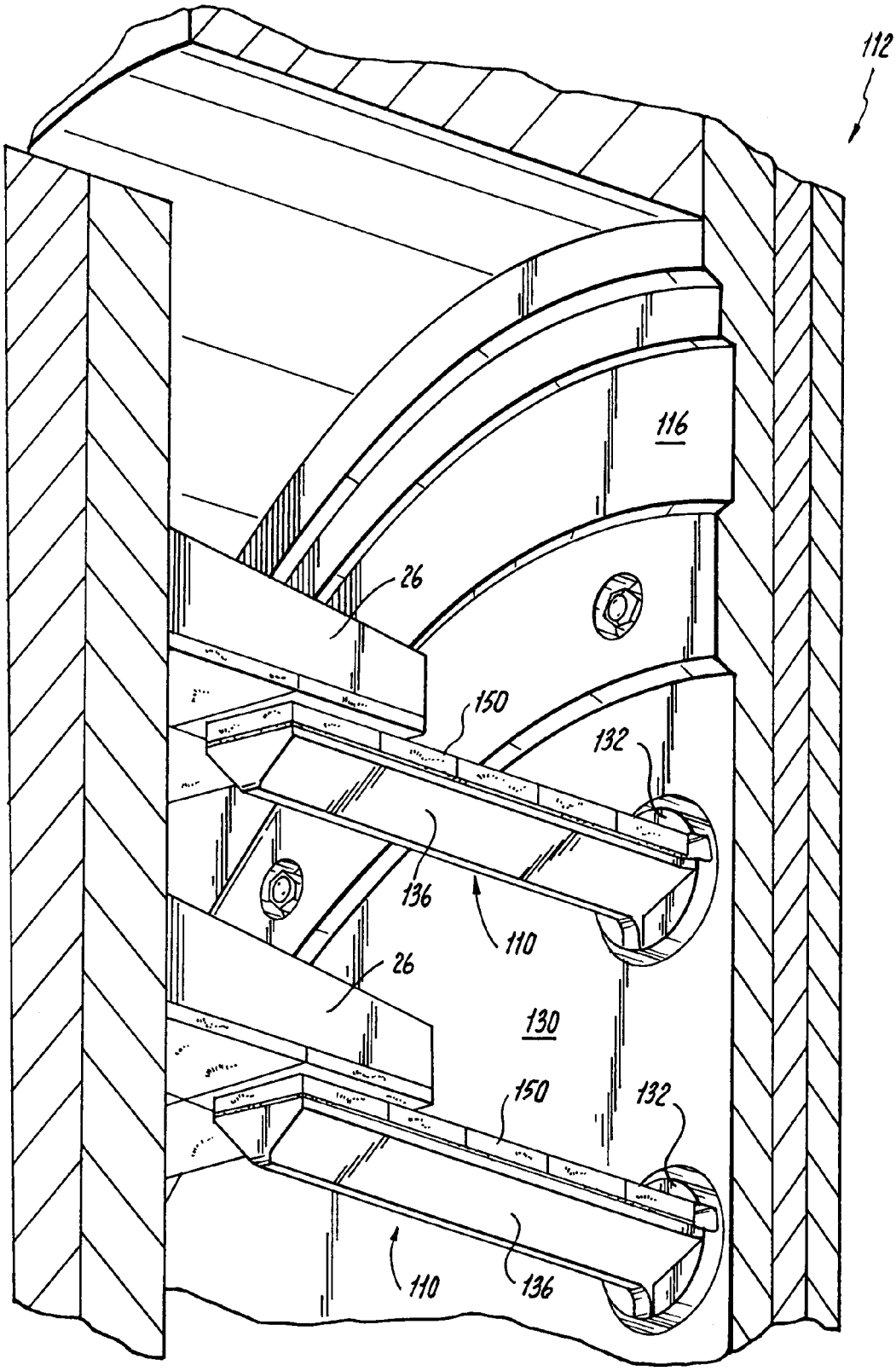
FIG. 12 is a partial perspective view of the interior of the grinding section of a coal pulverizer, illustrating stationary pegs constructed in accordance with the present invention secured to an interior wall of the grinding section and arrangement of the stationary pegs with respect to the other parts in the grinding section.

As can also be seen in FIGS. 4 and 5, prior art peg 24 includes a circular base portion 32 with an outer rim 34 connected with elongate fluted portion 36 having a planar upper surface 38 and symmetrical side grooves 40. Peg 24 has a generally T-shaped cross-sectional profile. A layer of protective material 42 is disposed on upper surface 38 of fluted portion 36. Protective layer 42 gradually increases along upper surface 38 from base 32 at a thickness $T_1$ of 3/16 in. (about 4.8 mm) to achieve a maximum thickness $T_2$ of 3/8 in. (about 9.5 mm) at tip 44 of elongate fluted portion 36. A strip of a protective material 46 having a thickness of $T_3$ of 1/8 in. (about 3.2 mm) is disposed on each opposing side groove 38 of fluted portion 36.

Some of the problems associated with prior art peg 24 relates to brittleness. Also, base portion 32 generally wears out before protective layer 42 on elongate fluted portion 36, and the increased protective layer 42 at tip 44 last longer than the remainder of the protective layer 42 on upper surface 38 of fluted portion 36.

In contrast, FIGS. 6-12 illustrate a stationary peg 110 constructed in accordance with the present invention. Peg 110 includes a cylindrical base portion 132 having a front surface 152 connected with an elongate portion 136 that possesses a generally triangular cross sectional profile. A layer 142 of a protective material is disposed on upper surface 138 of elongate portion 136.

Base portion 132 includes a rim 134 for facilitating attachment of peg 110 to an interior grinding section wall 130 so that elongate portion 136 extends substantially perpendicular with respect to wall 130 and does not contact grinding and impeller clips 26 in grinding section 116 of pulverizer 112. In use, the triangular shape of elongate portion 136 results in greater durability and reduced wear on peg 110, among other things, as compared with prior art peg 24.

Peg 110 also includes a groove 148 formed in circular base portion 132 adjacent the point of convergence between upper surface 138 of elongate portion 136 and base portion 132. Groove 148 is positioned adjacent the upper surface 138 of elongate portion 136, in the same plane as layer 142, and is configured to accommodate at least a portion of layer 142 therein. In this embodiment, layer 142 consists of square tiles 150. This arrangement reduces wear at base portion 132 of peg 110, among other things, as compared with prior art peg 24.

Preferably, peg 110 is made of Ni-Hard (i.e., cast iron to which nickel has been added to make it resist abrasion), formed by ductile forging to reduce the brittleness associated with prior art peg 24, which was solid Ni-Hard, but other materials and methods of formation can be used in accordance with the present invention. The protective material used in layer 142 or for tiles 150 is preferably tungsten carbide, but other materials having suitable durability, hardness or other advantageous characteristics can be used in accordance with the present invention. Generally, the protective material should provide greater resistance to wear and tear than the material used to form base portion 132 and elongate portion 136. Preferably, tiles 150 are about ¼ in., 5/16 in. or ⅜ in. (about 6.4 mm, 7.9 mm or 9.5 mm, respectively) in thickness.

It has been found that a stationary peg constructed in accordance with the present invention, such as peg 110, experiences a significantly longer wear life than prior art peg 24. However, it is to be understood that a stationary peg, such as peg 110, may be advantageously employed without the incorporation of each of the features disclosed herein. In addition, many industries include applications that utilize raw materials that are first broken up into relatively small sized particles. Accordingly, the raw materials are fed into devices that include one or more physical processes to reduce the size of the raw material prior to their use. A stationary peg constructed according to the present invention can be utilized for such purposes. Thus, it is to be further understood that modifications and variations may be utilized without departure from the spirit and scope of this inventive system and method, as those skilled in the art will readily understand. Such modifications and variations are considered to be within the purview and scope of the appended claims and their equivalents.

What is claimed is:

1. A stationary peg for attaching to an interior wall of a grinding chamber comprising:

a) a base portion having a front surface with a groove defined therein; and b) an elongate portion extending from the front surface of the base portion, the elongate portion having a uniform cross-sectional shape and area extending from a location proximate the base portion along the remainder of its length and having an upper surface including a layer of protective material disposed thereon, c) wherein the groove in the front surface of the base portion is positioned in the same plane as the layer of protective material and at least a portion of the layer of protective material is disposed in the groove.

2. A stationary peg as recited in claim 1, wherein the base portion is generally cylindrical having a length and a diameter wherein the diameter is larger in dimension than the length.

3. A stationary peg as recited in claim 1, wherein the base portion includes a rim for facilitating attachment of the stationary peg to the interior wall of the grinding chamber.

4. A stationary peg as recited in claim 1, wherein the elongate portion has a generally triangular cross-sectional profile.

5. A stationary peg as recited in claim 1, wherein the layer of protective material includes tiles fabricated of the protective material.

6. A stationary peg as recited in claim 1, wherein the protective material is tungsten carbide.

7. A stationary peg as recited in claim 1, wherein the base portion and the elongate portion are constructed of Ni-Hard.

8. A stationary peg for attaching to an interior wall of a grinding chamber comprising:

a) a base portion having a front surface with a groove defined therein; and b) an elongate portion having a first end attached to the base portion, the elongate portion extending from the front surface of the base portion, the elongate portion being integral with the base portion, the elongate portion having a uniform cross-sectional shape and area extending from a location proximate the first end along the remainder of its length, and having an upper surface including a layer of protective material disposed thereon, c) wherein the groove in the front surface of the base portion is positioned in the same plane as the layer of protective material and at least a portion of the layer of protective material is disposed in the groove.

9. A stationary peg as recited in claim 8, wherein the base portion is generally cylindrical having a length and a diameter wherein the diameter is larger in dimension than the length.

10. A stationary peg as recited in claim 8, wherein the base portion includes a rim for facilitating attachment of the stationary peg to the interior wall of the grinding chamber.

11. A stationary peg as recited in claim 8, wherein the elongate portion has a generally triangular cross-sectional profile.

12. A stationary peg as recited in claim 8, wherein the layer of protective material includes tiles fabricated of the protective material.

13. A stationary peg as recited in claim 8, wherein the protective material is tungsten carbide.

14. A stationary peg as recited in claim 8, wherein the base portion and the elongate portion are constructed of Ni-Hard.

15. A stationary peg having a length and being configured and adapted to attach to an interior wall of a grinding chamber, the stationary peg comprising:

a) a base portion having a front surface with a groove defined therein; and b) an elongate portion having a first end attached to the base portion, the elongate portion extending from the front surface of the base portion, the elongate portion having an upper surface including a layer of protective material disposed thereon along substantially the entire length of the stationary peg that is exposed to abrasive flow when installed in a grinding chamber, the elongate portion having a uniform cross-sectional shape and area extending from a location proximate the first end to a second free end along all of its length;

c) wherein the groove in the front surface of the base portion is positioned in the same plane as the layer of protective material and at least a portion of the layer of protective material is disposed in the groove.

16. A stationary peg as recited in claim 15, wherein the base portion is generally cylindrical having a length and a diameter wherein the diameter is larger in dimension than the length.

17. A stationary peg as recited in claim 15, wherein the base portion includes a rim for facilitating attachment of the stationary peg to the interior wall of the grinding chamber.

18. A stationary peg as recited in claim 15, wherein the elongate portion has a generally triangular cross-sectional profile.

19. A stationary peg as recited in claim 15, wherein the layer of protective material includes tungsten carbide tiles.

20. A stationary peg as recited in claim 15, wherein the base portion and the elongate portion are constructed of Ni-Hard.

* * * * *